US008062057B1

(12) United States Patent
Park

(10) Patent No.: US 8,062,057 B1
(45) Date of Patent: Nov. 22, 2011

(54) BRANCH CONNECTING STRUCTURE FOR HOISTWAY CABLE

(75) Inventor: Moon-Su Park, Seongnam-si (KR)

(73) Assignee: Daelim Electronics, Sujeong-Gu, Gyeonggi-Do, Seongnam-Si (KR)

( * ) Notice: Subject to any disclaimer, the term of this patent is extended or adjusted under 35 U.S.C. 154(b) by 0 days.

(21) Appl. No.: 13/031,774

(22) Filed: Feb. 22, 2011

(30) Foreign Application Priority Data

Jul. 28, 2010 (KR) ..... 20-2010-0007925 U

(51) Int. Cl.
*H01R 4/24* (2006.01)

(52) U.S. Cl. ..... 439/403

(58) Field of Classification Search ..... 439/403, 439/404, 405, 417
See application file for complete search history.

(56) References Cited

U.S. PATENT DOCUMENTS

2007/0054540 A1* 3/2007 Takeda ..... 439/404
2011/0151708 A1* 6/2011 Kaneko et al. ..... 439/404

* cited by examiner

*Primary Examiner* — Phuong Dinh
(74) *Attorney, Agent, or Firm* — Lexyoume IP Group, PLLC.

(57) ABSTRACT

Disclosed herein is a branch connecting structure for a hoistway cable. The structure includes a hoistway cable having a plurality of communication wires in a sheath. A branch cable connects each communication wire to a hall button or an indicator. A terminal block covers a first surface of the hoistway cable, and includes wire terminal members integrally having an input terminal and an output terminal. A branch block covers a first surface of the branch cable, and includes branch terminal members integrally having an input terminal and an output terminal. A first support block covers a second surface of the hoistway cable, and is compressed against the terminal block to be coupled thereto. A second support block covers a second surface of the branch cable, and is compressed against the branch block to be coupled thereto. A cover covers outer circumferences of the terminal block and the branch block.

14 Claims, 8 Drawing Sheets

BRANCH CONNECTING STRUCTURE FOR HOISTWAY CABLE

CROSS-REFERENCE TO RELATED APPLICATION

This application claims priority to and the benefit of Korean Patent Application No. 20-2010-0007925 filed in the Korean Intellectual Property Office on Jul. 28, 2010, the entire contents of which are incorporated herein by reference.

BACKGROUND OF THE INVENTION

1. Field of the Invention

The present invention relates generally to a branch connecting structure for a hoistway cable and, more particularly, to a branch connecting structure for a hoistway cable, which is mounted to a wall of a hoistway to make communication between a machine room for controlling an elevator, and a hall button, provided on a side of an entrance to the elevator in a building and used by a user on each floor to call the elevator, and an indicator indicating the floor at which the elevator is located.

2. Description of the Related Art

Generally, an elevator, which is used to transport people and freight in a vertical direction, has a hall button on each floor of a building in which the elevator is installed. The hall button is provided on a wall around an entrance to the elevator, and is used by a user to call the elevator. Further, an indicator is provided to indicate in real-time the floor at which the elevator is located currently. The hall button and the indicator are electrically connected to a controller of a machine room which is provided on the upper portion of a hoistway that is the passage through which the elevator moves up and down, so as to control the elevator, so that communication is performed between the hall button and the indicator and the machine room.

Here, a communication cable connecting the hall button and the indicator with the controller of the machine room is commonly referred to as a hoistway cable. The hoistway cable is vertically mounted to a wall of the hoistway, and branches at each floor to be connected to the hall button and the indicator. FIG. 1 schematically shows a conventional branch connecting structure for a hoistway cable.

The conventional hoistway cable comprises a round cable, and includes a plurality of communication wires in a sheath of the cable. Conventionally, in order to branch the hoistway cable to be connected to the hall button and the indicator, as shown in FIG. 1, the hoistway cable is made in the shape of a loop at a branch position and then is fastened by a cable tie. After a sheath is removed from a portion of the loop, one end of a branch cable is connected to each communication wire, and the other end of the branch cable is connected to the hall button and the indicator. Further, in order to prevent undesirable movement, the hoistway cable is fastened to a wall of the hoistway by providing fastening means, such as a fastening clip or a fastening bracket, at predetermined intervals.

However, such a method has the drawback of several operations, including the operation of forming the hoistway cable in the shape of the loop, the operation of fastening the loop by the cable tie, the sheath removing operation, etc., being required, so that the work is difficult and complicated. Further, over time, the cable tie may become unfastened by the hoistway cable's own load so that the loop may be undesirably undone, and thus the hoistway cable may become disconnected from the hall button or the indicator.

In order to solve the problems, the inventors of the present invention have proposed Korean U.M. Registration No. 20-448693. This includes a hoistway cable, a branch cable, a terminal block, and a support block. The hoistway cable has a plurality of communication wires which are arranged in parallel in a sheath having the shape of a flat band. The branch cable connects each communication wire of the hoistway cable with a hall button or an indicator. The terminal block is equipped with a terminal member which cuts through the sheath of the hoistway cable and penetrates into the sheath to be connected to each communication wire. The support block is compressed against and coupled to the terminal block, thus supporting the hoistway cable on the terminal block with each communication wire and the terminal member being connected to each other at a precise position.

According to the U.M. Registration No. 448693, after the conventional hoistway cable comprising a round cable is formed in the shape of the flat band, the terminal block having the terminal member which is connected to each of the communication wires arranged to be parallel to each other is coupled to the hoistway cable. Thereafter, the hoistway cable and the terminal block are secured while being connected to each other by the support block. Each rod terminal of the branch cable is inserted into a terminal hole which is formed in the terminal block.

This is advantageous in that it is unnecessary to manually remove the sheath for the sake of branching and connecting the hoistway cable, and it is easy to distinguish the communication wires in the hoistway cable from each other.

However, this is problematic in that each rod terminal of the branch cable must be individually connected to the terminal hole formed in the terminal block, and it must be verified whether each rod terminal of the branch cable corresponds to each communication wire of the hoistway cable before the rod terminal is connected to the communication wire.

SUMMARY OF THE INVENTION

Accordingly, the present invention has been made keeping in mind the above problems occurring in the prior art, and an object of the present invention is to provide a branch connecting structure for a hoistway cable, which obviates the necessity of manually removing a sheath for the sake of branching and connecting of the hoistway cable, makes it easy to couple the hoistway cable with a branch cable, makes it easy to distinguish communication wires in the hoistway cable and the branch cable from each other, prevents terminal members connected to the communication wires from making contact with each other by cutting the sheath of each of the hoistway cable and the branch cable and thereafter adjusting the positions of the terminal members connected to the communication wires, and makes mass production possible in a harness type using automated equipment.

In order to accomplish the above object, the present invention provides a branch connecting structure for a hoistway cable, including a hoistway cable including a sheath which has a shape of a flat band, and a plurality of communication wires which are accommodated in the sheath in such a way as to be spaced apart from each other by predetermined intervals and to be parallel to each other; a branch cable connecting each of the communication wires of the hoistway cable to a hall button or an indicator; a terminal block covering a first surface of the hoistway cable, and equipped with wire terminal members, each of which has an input terminal and an output terminal that are integrated with each other, the input terminal being provided on a first end of the wire terminal member and cutting the sheath of the hoistway cable and penetrating into the sheath to be connected to each of the communication wires, the output terminal being provided on a second end of the wire terminal member and connected to the branch cable; a branch block covering a first surface of the branch cable, and equipped with branch terminal members, each of which has an input terminal and an output terminal that are integrated with each other, the input terminal being provided on a first end of the branch terminal member and cutting a sheath of the branch cable and penetrating into the sheath to be connected to each of the communication wires, the output terminal being provided on a second end of the branch terminal member and connected to the hoistway cable; a first support block covering a second surface of the hoistway cable, and compressed against the terminal block to be coupled thereto, thus supporting the hoistway cable on the terminal block with each of the communication wires being connected to the wire terminal member; a second support block covering a second surface of the branch cable, and compressed against the branch block to be coupled thereto, thus supporting the branch cable on the branch block with each of the communication wires being connected to the branch terminal member; and a cover coupled to cover outer circumferences of the terminal block and the branch block.

Further, the wire terminal members, which have been connected to the communication wires arranged in the hoistway cable in parallel, may be arranged in a zigzag fashion so as to prevent a short circuit.

Furthermore, the output terminal of each of the branch terminal members may be bent to be in contact with the output terminal of each of the wire terminal members.

Further, the terminal block and the first support block may be coupled to each other using a hook, and the branch block and the second support block may be coupled to each other using a hook.

The branch connecting structure may further include a seal ring provided between the terminal block and the branch block.

The branch connecting structure may further include a waterproof member provided on each of opposite surfaces of the hoistway cable, thus sealing a gap between the hoistway cable and the terminal block which is in contact with the hoistway cable or a gap between the hoistway cable and the first support block which is in contact with the hoistway cable.

The branch connecting structure may further include a waterproof member provided on each of opposite surfaces of the branch cable, thus sealing a gap between the branch cable and the branch block which is in contact with the branch cable or a gap between the branch cable and the second support block which is in contact with the branch cable.

Further, each of the hoistway cable and the branch cable may include grooves on an outer surface thereof on which the communication wires are placed, and each of the first and second support blocks may include protrusions which are arranged at predetermined intervals and are inserted into the corresponding grooves.

As is apparent from the above description, the present invention is advantageous in that a hoistway cable is reliably branched off for and connected to every floor, it is easy to work because the hoistway cable and a branch cable may be connected to each other at one time without manually performing complicated operations, including a cable peeling operation, a loop forming operation, a wire connecting operation, and an insulating tape wrapping operation, and it requires only an operation of connecting the branch cable to a hall button and an indicator in a site because the hoistway cable, a connector, and the branch cable may be mass produced in a harness structure beforehand in a factory, thus achieving the effect of saving on labor costs due to automating production.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
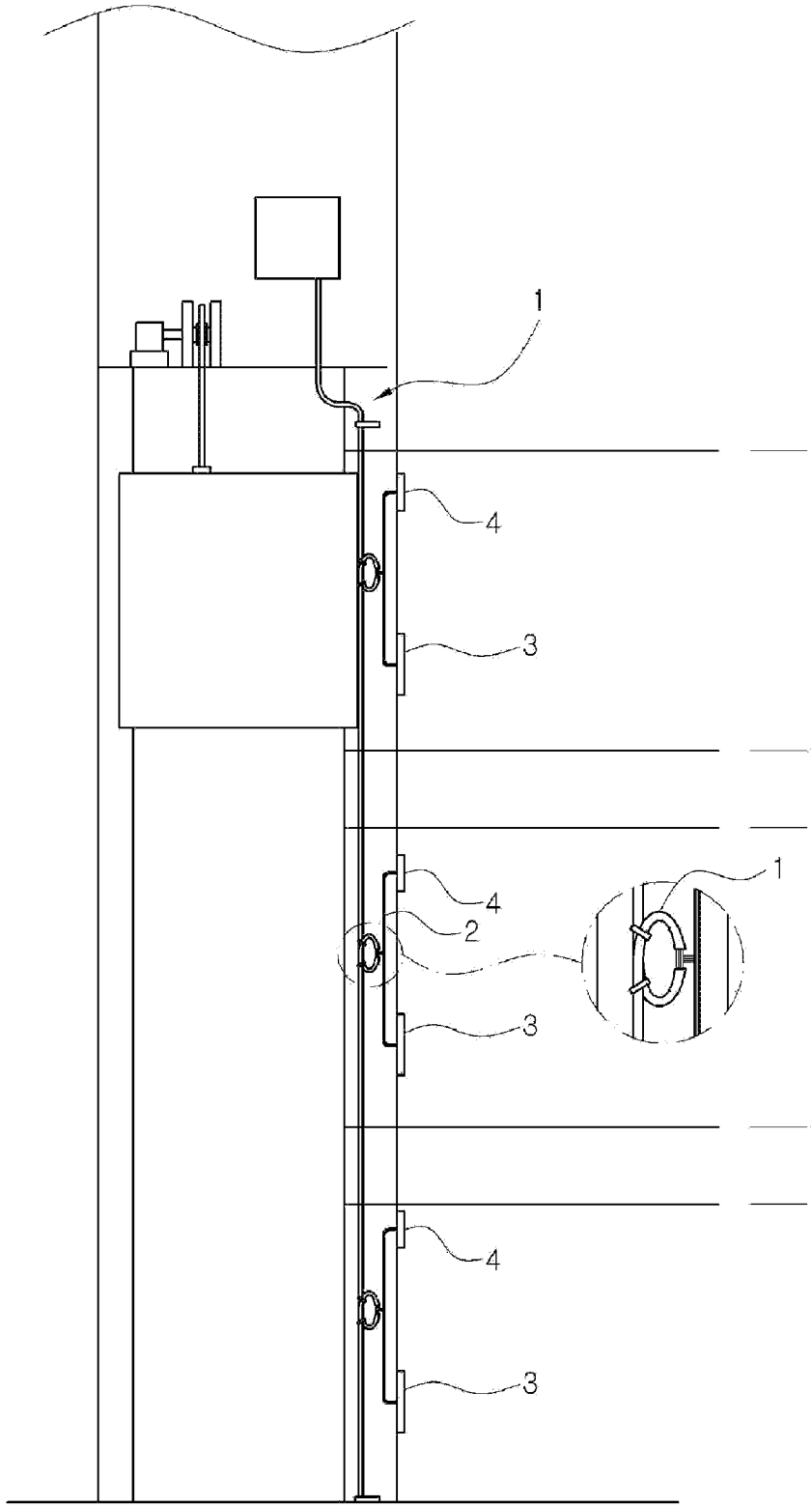
FIG. 1 is a schematic view showing a conventional branch connecting structure for a hoistway cable.
Figure 2:
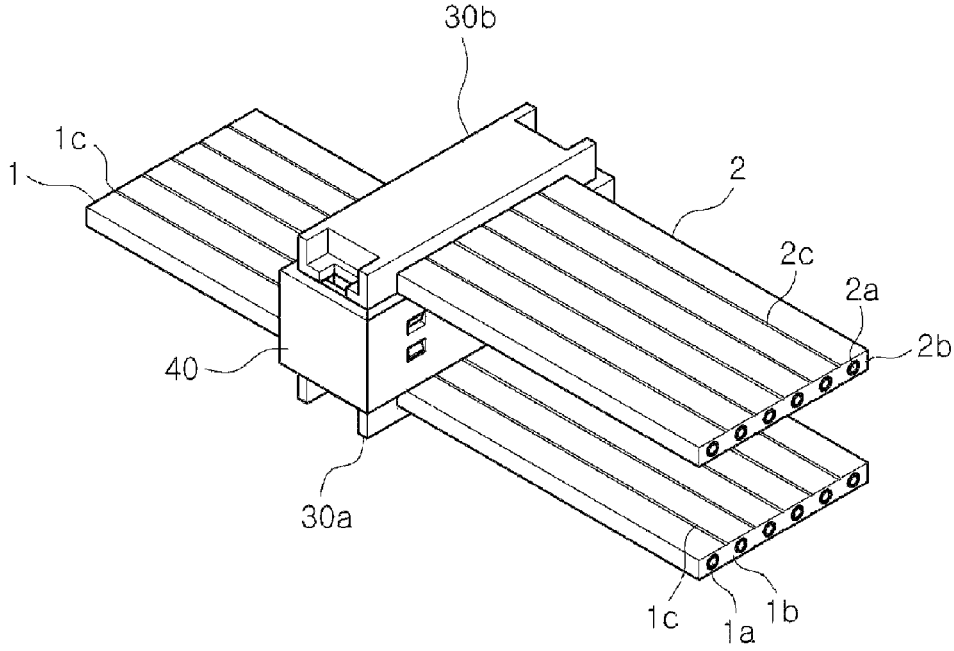
FIG. 2 is a perspective view showing a branch connecting structure for a hoistway cable according to the present invention.

Hereinafter, a branch connecting structure for a hoistway cable according to a preferred embodiment of the present invention will be described in detail with reference to the accompanying drawings.

According to the present invention, as shown in FIGS. 2 to 6, a hoistway cable 1, a connector C, and a branch cable 2 are provided to branch the hoistway cable 1 and thus connect the hoistway cable 1 to a hall button 3 and an indicator 4 of each floor.

The hoistway cable 1 has a shape of a flat band, and includes a plurality of communication wires 1*a* which are accommodated in a urethane sheath 1*b* and are spaced apart from each other at predetermined intervals in such a way as to be parallel to each other. Preferably, a portion in which each communication wire 1*a* is placed protrudes in a rectangular or circular shape. Further, grooves 1*c* are formed in portions of the sheath 1*b* in which the respective communication wires 1*a* are placed.

The hoistway cable 1 extends lengthwise in a longitudinal direction, and is vertically fastened to a wall of a hoistway by a fastening means, such as a bracket or a fastening clip.

Protrusions 34*a* formed on a first support block 30*a* which will be described below are inserted into the grooves 1*c*, thus preventing the undesirable movement of the hoistway cable 1 which is placed in the first support block 30*a*.

The hoistway cable 1 constructed as described above is advantageous in that the communication wires 1*a* are placed at predetermined positions in such a way as to be spaced apart from each other at predetermined intervals, so that it is easy to distinguish the communication wires 1*a* from each other, thus preventing communication problems from occurring because of improper connections, and it is easy to work.

The connector C is the connecting means for the branch connection of the hoistway cable 1, and includes a terminal block 10, a branch block 20, the first support block 30*a*, a second support block 30*b*, and a cover 40.

The terminal block 10 covers one surface of the hoistway cable 1, and connects each communication wire 1*a* of the hoistway cable 1 with the branch cable 2 that will be described below. A body of the terminal block 10 is generally made of a synthetic resin material. Wire terminal members 11 having electric conductivity are installed in the body by an insert molding method. Moreover, the terminal block 10 has in left and right side ends thereof hook insert holes 12 so that hooks 31*a* of the first support block 30*a* are inserted into the hook insert holes 12. Terminal holes 14 and an insert groove 15 are formed in the top of the terminal block 10. Branch terminal members 21 installed in the branch block 20, which will be described below in detail, by the insert molding method are connected to the terminal holes 14. A seal ring 50 is inserted into the insert groove 15 to perform a waterproofing function. A plurality of coupling protrusions 13 is provided on the front and back of the terminal block 10 to be inserted into and secured to coupling holes 41 of the cover 40.

Here, each hook insert hole 12 further includes a locking protrusion 121 to lock the inserted hook 31*a* to a predetermined position.

Each wire terminal member 11 is an electric conductor having an input terminal 111 and an output terminal 113 that are integrated with each other. The input terminal 111 is provided on one end of the wire terminal member 11, cuts the sheath 1*b* of the hoistway cable 1 and penetrates into the cable 1 to be connected to each communication wire 1*a*. The output terminal 113 is provided on the other end of the wire terminal member 11, and is connected to each branch terminal member 21 which is mounted to the branch block 20.

Here, each wire terminal member 11 is installed in the terminal block 10 by the insert molding method. In order to prevent the wire terminal members 11 from being short-circuited when they are connected to the communication wires 1*a* which are provided in the hoistway cable 1 in such a way as to be parallel to each other, it is preferable that the wire terminal members 11 be arranged in a zigzag fashion.

As shown in FIG. 4A, each wire terminal member 11 has the structure of a two-pronged spear. That is, the wire terminal member 11 has a blade such that a front end of the input terminal 111 cuts the sheath 1*b* of the hoistway cable 1 to penetrate into the cable 1, and protrudes from a surface of the terminal block 10. A connection groove 112 is formed in a central portion of the input terminal 111 so that one strand of communication wire 1*a* of the hoistway cable 1 is inserted into the connection groove 112. The connection groove 112 extends lengthwise in a longitudinal direction of the wire terminal member 11.

Here, a length of the input terminal 111 is set such that the input terminal 111 is connected to the communication wire 1*a* after cutting the sheath 1*b* of the hoistway cable 1. Preferably, the length of the input terminal 111 is set such that the input terminal 111 does not pass completely through the sheath 1*b* of the hoistway cable 1.

The output terminal 113 is coupled to the rear end of the input terminal 111, and is connected to an output terminal 213 of the branch block 20, which will be described below. As shown in FIG. 4A, the output terminal 113 extends in a longitudinal direction from the rear end of the input terminal 111, and is fitted into the corresponding terminal hole 14 of the terminal block 10. When the output terminal 213 of the branch block 20 is inserted into the terminal hole 14, the inserted output terminal 213 makes surface contact with the output terminal 113 of the terminal block 10, thus applying an electric current.

The output terminal 113 may further include a circular projection 114 which protrudes towards a surface making contact with the output terminal 213. The circular projection 114 serves to apply an electric current between the two terminals 113 and 213 when the output terminal 113 and the output terminal 213 are loosely inserted into the terminal hole 14.

FIG. 4B shows the structure of the branch terminal member 21 which is installed in the branch block 20 by the insert molding method. An input terminal 211 has the same shape as the above-mentioned input terminal 111 of the wire terminal member 11. The input terminal 211 is connected to each communication wire 2*a* placed in a sheath 2*b*, after cutting the sheath 2*b* of the branch cable 2. The output terminal 213 protrudes outwards to be inserted into the terminal hole 14 which is formed in the terminal block 10, and is bent to be inserted into the terminal hole 14 while overlapping the output terminal 113 of the wire terminal member 11 which is disposed in the inner circumference of the terminal hole 14.

The structures of the wire terminal member 11 and the branch terminal member 21 have been described in detail. After the input terminal 111 and the input terminal 211 cut the sheath 1*b* of the hoistway cable 1 and the sheath 2*b* of the branch cable 2, the input terminal 111 and the input terminal 211 penetrate into the sheaths 1*b* and 2*b* to be connected to the communication wires 1*a* and 2*a*. As long as the output terminal 113 may be connected to the output terminal 213, the output terminals 113 and 213 are not limited to a specific structure.

The branch block 20 covers one surface of the branch cable 2, and is coupled with the terminal block 10 to apply an electric current between the hoistway cable 1 and the branch cable 2. A body of the branch block 20 is generally made of a synthetic resin material. Each branch terminal member 21 having electric conductivity is installed in the body by the insert molding method.

Further, the branch block 20 has in left and right side ends thereof hook insert holes 22 so that hooks 31*b* of the second support block 30*b* are inserted into the hook insert holes 22. An insert groove 25 is formed in a surface which makes contact with the terminal block 10, so that the seal ring 50 is inserted into the insert groove 25. A stopper 24 is provided on a side on which the input terminal 211 of each branch terminal member 21 is placed so as to prevent the branch cable 2 from protruding outwards. A plurality of coupling protrusions 23 is provided on the front and back of the branch block 20, and is inserted into the corresponding coupling holes 41 of the cover 40, which will be described below.

Each hook insert hole 22 further includes a locking protrusion 221 which is inserted into a locking hole 32*b* formed in the second support block 30*b*.

The stopper 24 functions to support an end of the branch cable 2. The stopper 24 is placed to be parallel to a direction in which the input terminals 211 are arranged, and prevents the undesirable movement of the branch cable 2 when each input terminal 211 cuts the sheath 2*b* of the branch cable and thereafter is connected to the corresponding communication wire 2*a*.

The first support block 30*a* covers the other surface of the hoistway cable 1, and supports the hoistway cable 1 and the terminal block 10 which are connected to each other. The hooks 31*a* protrude from the left and right side ends of the first support block 30*a*. The protrusions 34*a* are provided on an inner surface 33*a* in which the hoistway cable 1 is seated, and are inserted into the corresponding grooves 1*c* which are formed in the hoistway cable 1, thus preventing the removal of the seated hoistway cable 1 while work is being performed.

The hooks 31*a* are fitted into the corresponding hook insert holes 12 which are formed in opposite ends of the terminal block 10. Here, a locking hole 32*a* is formed in each hook 31*a* so that the locking protrusion 121 formed in each hook insert hole 12 is inserted into the locking hole 32*a*, thus increasing a coupling force between the terminal block 10 and the first support block 30*a*.

The inner surface 33*a* of the first support block 30 has a depth which corresponds to the thickness of the seated hoistway cable 1, thus pressing and locking the hoistway cable 1 between the terminal block 10 and the first support block 30*a*.

The second support block 30*b* covers the other surface of the branch cable 2, and functions to support the branch cable 2 and the branch block 20 which are connected to each other. The hooks 31*b* protrude from the left and right side ends of the second support block 30*b*. The protrusions 34*b* are provided on an inner surface 33*b* in which the branch cable 2 is seated, and are inserted into the corresponding grooves 2*c* which are formed in the branch cable 2, thus preventing the removal of the seated branch cable 2 while work is being performed.

Since the second support block 30*b* has the same construction as the above-mentioned first support block 30*a*, the detailed description of the second support block 30*b* will be omitted herein.

The cover 40 is coupled to surround the outer surfaces of the terminal block 10 and the branch block 20 while the terminal block 10 and the branch block 20 press and lock the hoistway cable 1 and the branch cable 2 in cooperation with the first support block 30*a* and the second support block 30*b*, thus preventing the inflow of foreign matter and moisture. The cover 40 has the shape of a rectangular casing which is hollow therein. Coupling holes 41 are formed in the cover 40 such that the coupling protrusions 13 provided on the front and back of the terminal block 10 and the coupling protrusions 23 provided on the front and back of the branch block 20 are coupled to the coupling holes 41.

The branch cable 2 serves to connect each communication wire 1*a* of the hoistway cable 1 to the hall button or the indicator. The branch cable 2 is cut by the distance necessary to connect the hoistway cable 1 to the hall button or the indicator, and has the same shape and construction as the hoistway cable 1.

Therefore, after the branch cable 2 is mass produced using automated equipment, it can be cut to a proper length, thus increasing the ease of manufacture.

Figure 3A:
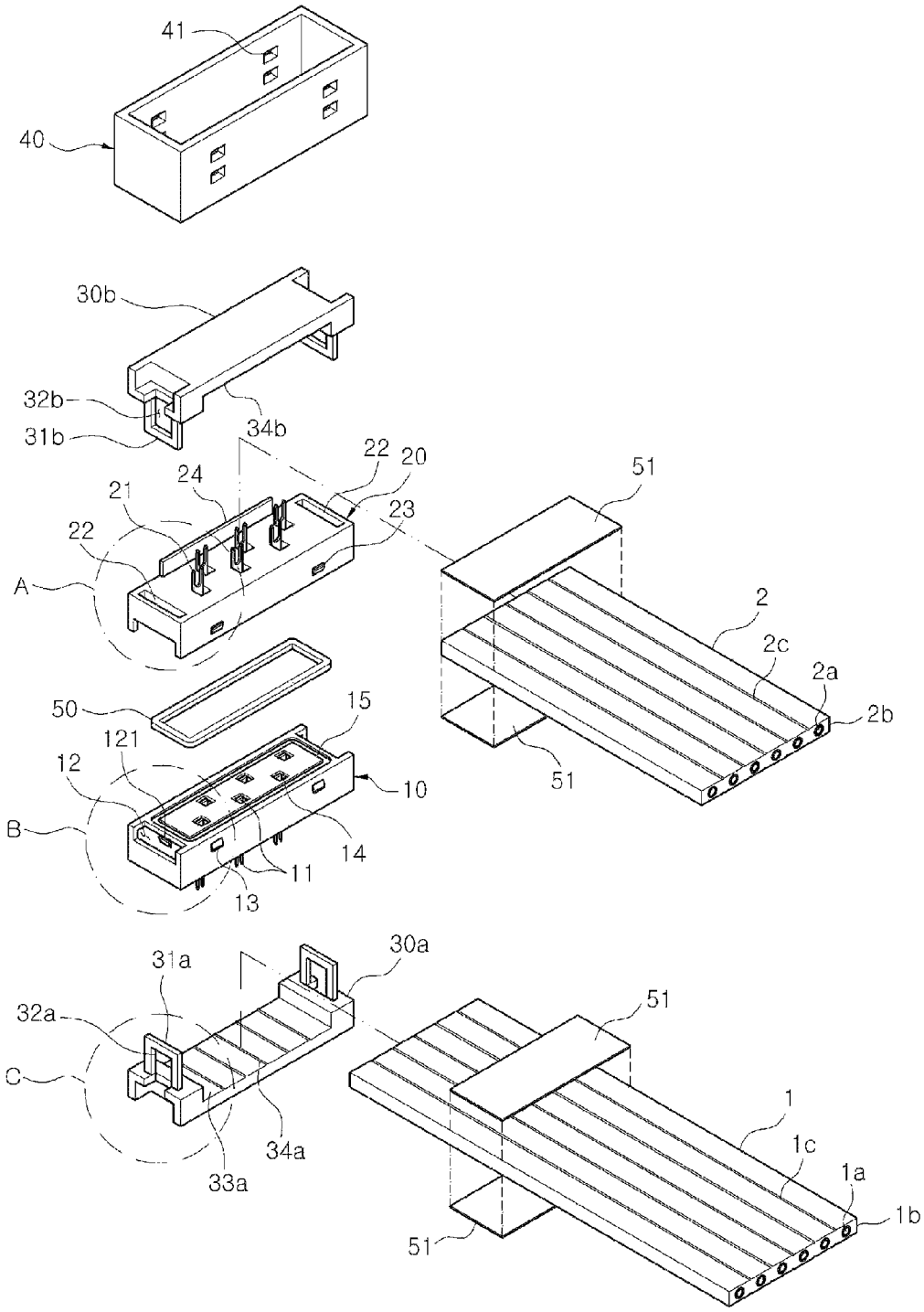
FIG. 3A is an exploded perspective view of FIG. 2.
Figure 3B:
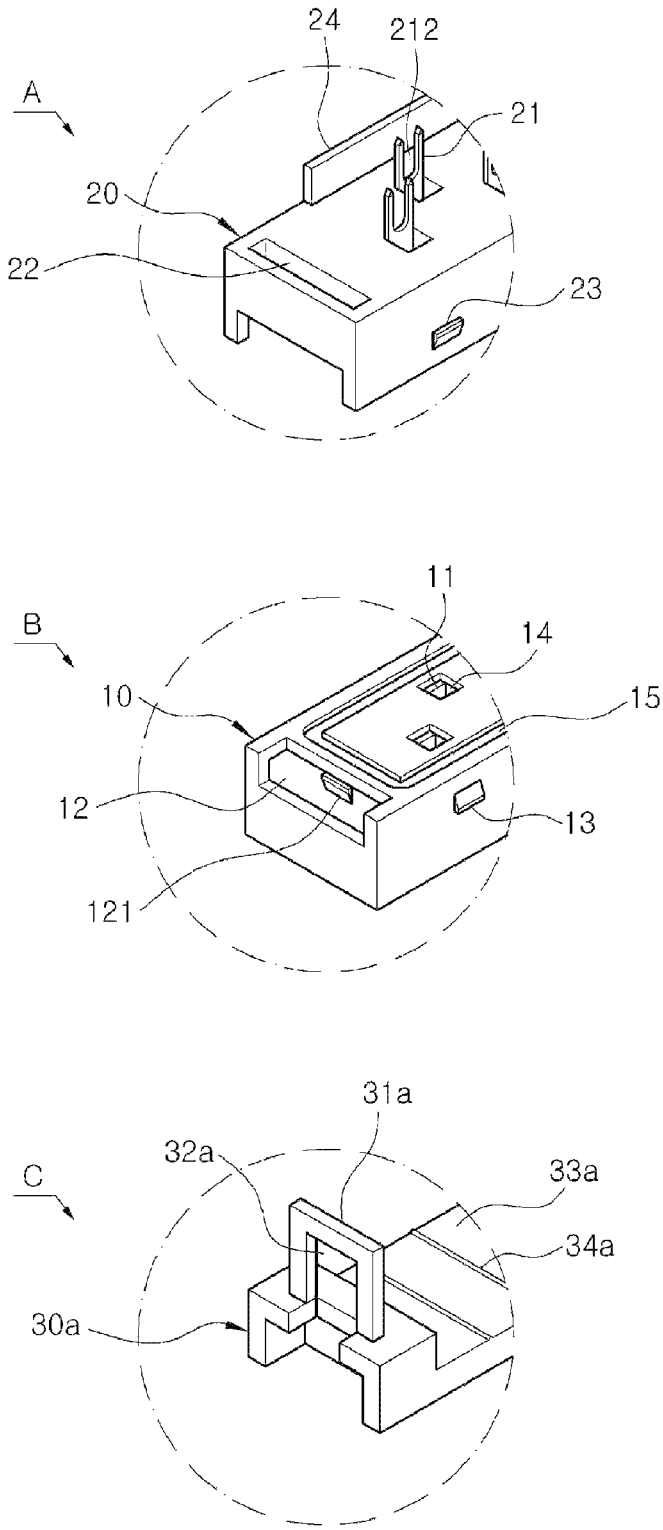
FIG. 3B is a partially enlarged view of FIG. 3A.
Figure 4:
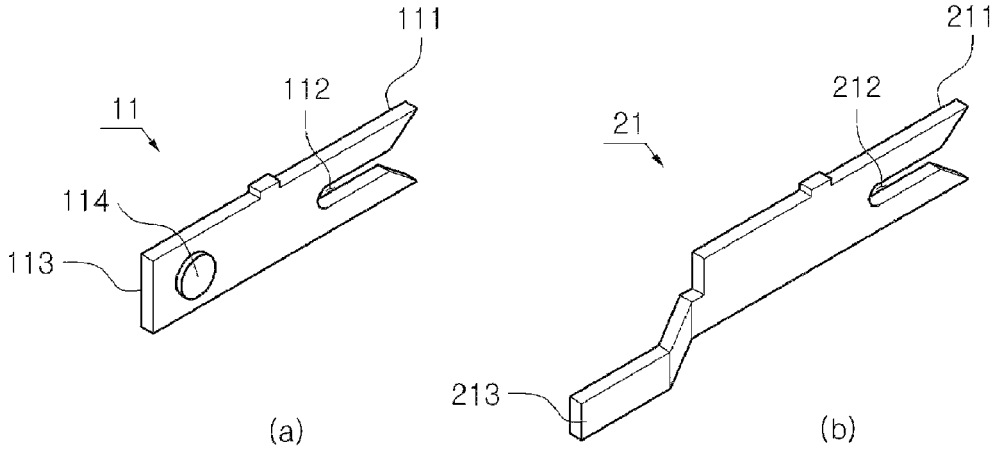
FIGS. 4A and 4B are perspective views showing the structure of a wire terminal member and a branch terminal member of a connector according to the present invention.

The seal ring 50 disposed in the insert groove 15 of the terminal block 10 and the insert groove 25 of the branch block 20 functions to prevent water from penetrating into the branch connecting part of the hoistway cable 1 when water gets into the hoistway. As shown in FIGS. 3A and 3B, the seal ring 50 usually has the shape of a rectangular ring which is hollow therein, and is placed on a coupled portion when the terminal block 10 and the branch block 20 are coupled to both sides of the hoistway cable 1, thus preventing water from entering a junction between the branch terminal member 21 mounted to the branch block 20 and the wire terminal member 11 mounted to the terminal block 10, therefore preventing a short circuit and an electric shock.

Moreover, in order to provide a waterproofing effect, waterproof members 51 may be attached to a contact portion between the hoistway cable 1 and the terminal block 10 and to a contact portion between the branch cable 2 and the branch block 20. One waterproof member 51 is positioned between the hoistway cable 1 and the input terminal 111 inserted into the sheath 1*b* of the hoistway cable 1 after cutting the sheath 1*b*, thus preventing outside water from penetrating the inside. Another waterproof member 51 is provided between the branch block 20 and the branch cable 2 to achieve the same effect as the above-mentioned waterproof member 51.

The waterproof member 51 may comprise tape, double-sided tape, a pad, a sheet, etc. to be attached to or placed on the contact portion, and may be applied using a waterproof material such as silicone.

Figure 5A:
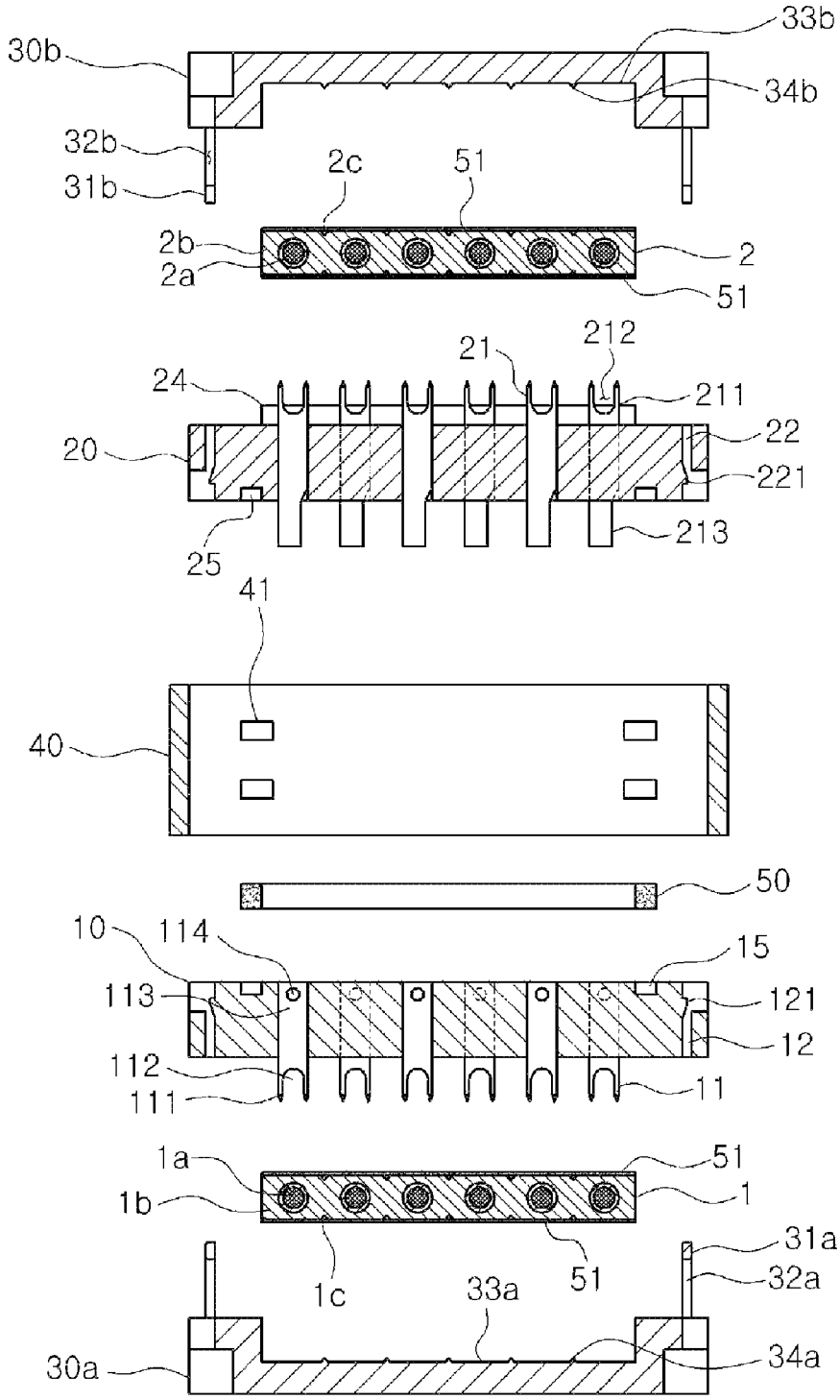
FIGS. 5A, 5B, and 5C are views sequentially showing a branch connecting method of a hoistway cable according to the present invention.
Figure 5B:
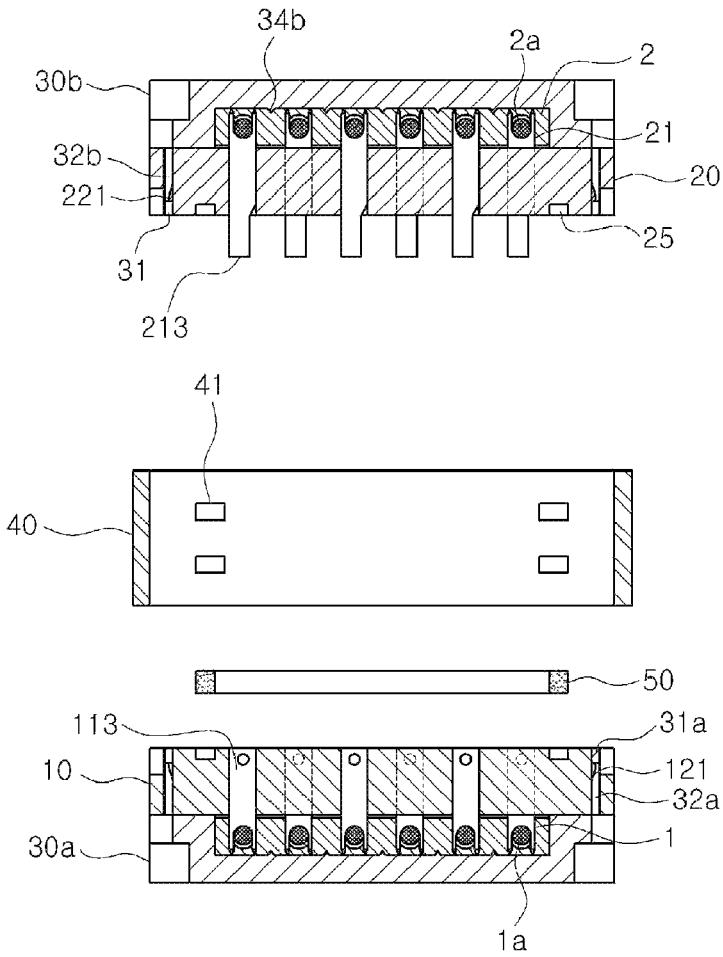
Figure 5C:
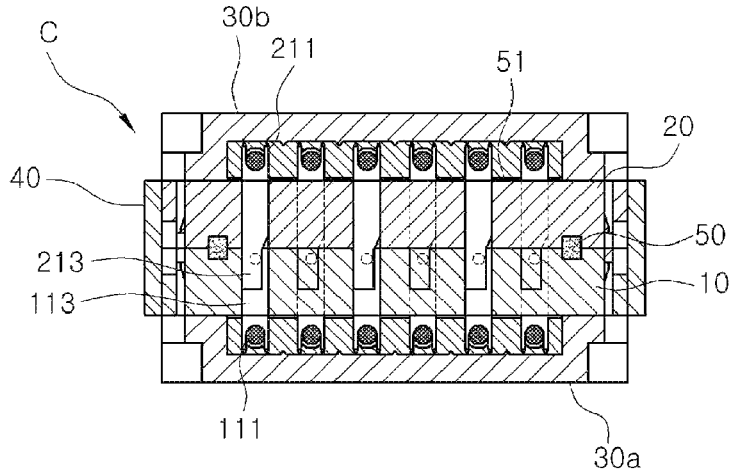
Figure 6:
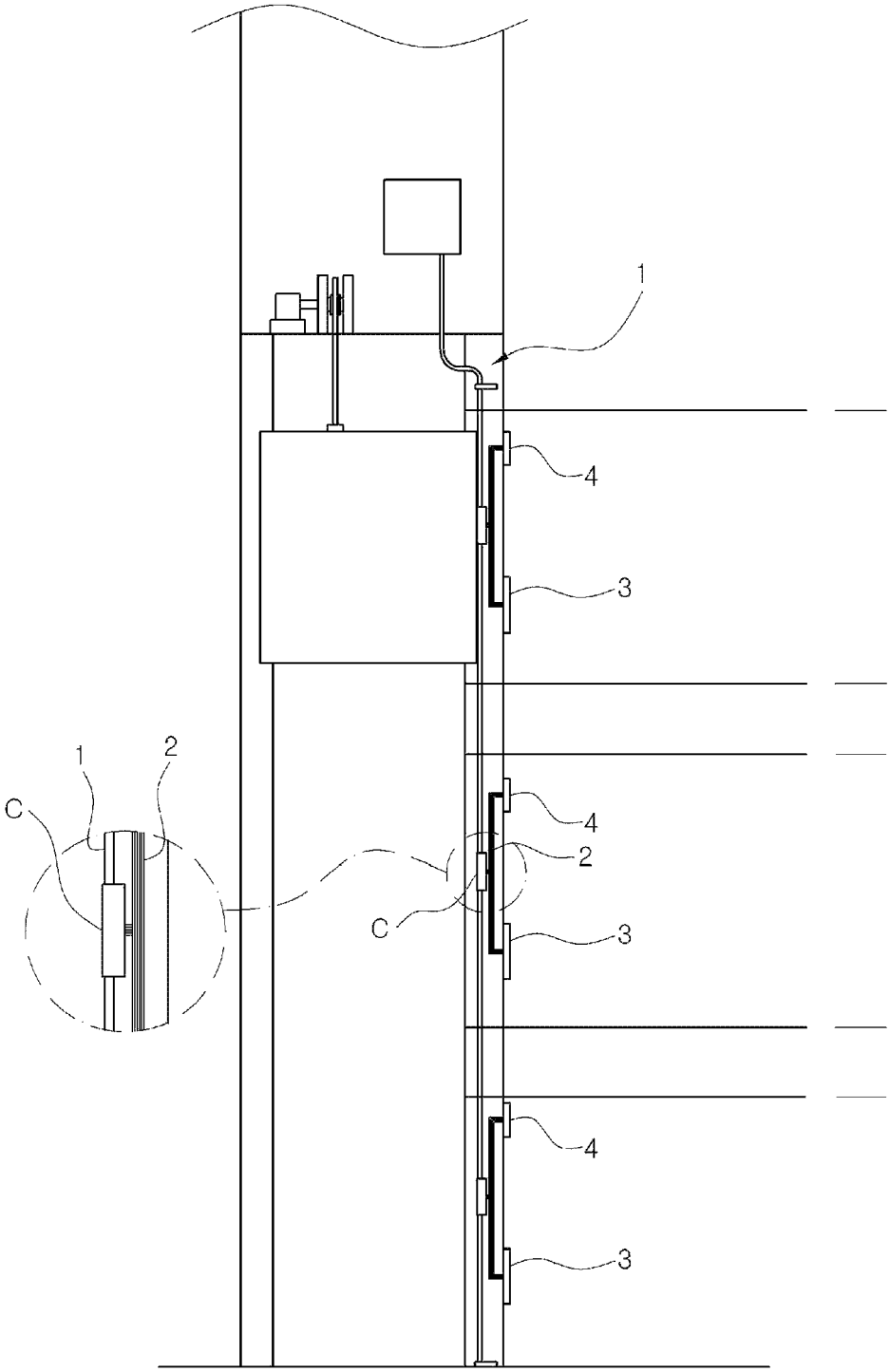
FIG. 6 is a view showing the state in which the hoistway cable according to the present invention is branch connected.

FIGS. 5A, 5B, and 5C are views sequentially showing a branch connecting method of the hoistway cable 1 according to the present invention, and FIG. 6 is a view showing the state in which the hoistway cable 1 according to the present invention is branch connected.

As shown in FIGS. 5A, 5B, and 5C, first, the hoistway cable 1 is seated on the inner surface 33 of the first support block 30*a*, so that the protrusions 34*a* formed on the first support block 30*a* are inserted into the grooves 1*c* formed in the hoistway cable 1, and thus the hoistway cable 1 is locked to a predetermined position. Thereafter, after the input terminal 111 of each wire terminal member 11 of the terminal block 10 is placed towards the inner surface 33*a* of the first support block 30*a* and is aligned with the corresponding communication wire 1*a* of the hoistway cable 1, the input terminal 111 is compressed against the communication wire 1*a* by a manual operation or a tool such as a jig.

In the compressed state, the front end of the input terminal 111 of the wire terminal member 11 cuts and penetrates into the sheath 1*b* of the hoistway cable 1. As each communication wire 1*a* is inserted into the corresponding connection groove 112 of the input terminal 111, the communication wire 1*a* and the wire terminal member 11 are electrically connected to each other.

Simultaneously, the hooks 31*a* provided on the left and right side ends of the first support block 30*a* are fitted into the hook insert holes 12 of the terminal block 10, and the locking protrusions 121 formed in the hook insert holes 12 are inserted into the locking holes 32*a* of the hooks 31*a*. Thereby, the wire terminal member 11 and the hoistway cable 1 are firmly coupled while an electrical connection is formed therebetween.

As such, the cover 40 is coupled to the terminal block 10 to which the first support block 30*a* and the hoistway cable 1 are coupled. At this time, the coupling protrusions 13 formed on the front and back of the terminal block 10 are inserted into the coupling holes 41 formed in the cover 40, thus preventing the inflow of foreign matter and moisture from the outside.

Next, the branch block 20 is placed towards the interior of the cover 40 and then is coupled with the terminal block 10. The output terminal 213 of each branch terminal member 21 mounted to the branch block 20 by the insert molding method is fitted into the corresponding terminal hole 14 of the terminal block 10.

After the branch cable 2 is seated on the inner surface 33*b* of the second support block 30*b*, the second support block 30*b* is placed on a side at which the input terminal 211 of each branch terminal member 21 of the branch block 20 is located. Thereafter, the branch block 20 and the branch cable 2 are compressed against and coupled with each other by a manual operation or by using a jig or the like. Thereby, the front end of the input terminal 211 cuts the sheath 2*b* of the branch cable 2 and then is connected to the corresponding communication wire 2*a* in the branch cable 2. In order to prevent the branch cable 2 from being dislodged from a predetermined position during work, an end of the branch cable 2 is supported by the stopper 24 which is provided on the branch block 20.

Thereafter, another end of the branch cable 2 is connected to the hall button or the indicator, thereby completing the entire connecting operation.

When the branch cable 2 is connected to each input terminal 211, an electric current is applied between the hoistway cable 1 and the branch cable 2 through the output terminal 113 connected to each output terminal 213.

The seal ring 50 is further provided on the coupled portion between the branch block 20 and the terminal block 10, thus obtaining a waterproofing effect. Moreover, the cover 40 is provided to cover the coupled portion between the branch block 20 and the terminal block 10, thus preventing the inflow of foreign matter or moisture from the outside.

According to the above method, as shown in FIG. 6, the hoistway cable 1 is reliably branched off for and connected to every floor, it is easy to work because the hoistway cable and a branch cable may be connected to each other at one time without manually performing complicated operations, including the cable peeling operation, the loop forming operation, the wire connecting operation, and the insulating tape wrapping operation, and only the operation of connecting the branch cable 2 to the hall button and the indicator is required in a site because the hoistway cable 1, the connector C, and the branch cable 2 may be mass produced in a harness structure beforehand in a factory, thus achieving the effect of saving on labor costs due to automating production.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A branch connecting structure for a hoistway cable, comprising:

a hoistway cable including a sheath which has a shape of a flat band, and a plurality of communication wires which are accommodated in the sheath in such a way as to be spaced apart from each other by predetermined intervals and to be parallel to each other;

a branch cable connecting each of the communication wires of the hoistway cable to a hall button or an indicator;

a terminal block covering a first surface of the hoistway cable, and equipped with wire terminal members, each of which has an input terminal and an output terminal that are integrated with each other, the input terminal being provided on a first end of the wire terminal member and cutting the sheath of the hoistway cable and penetrating into the sheath to be connected to each of the communication wires, the output terminal being provided on a second end of the wire terminal member and connected to the branch cable;

a branch block covering a first surface of the branch cable, and equipped with branch terminal members, each of which has an input terminal and an output terminal that are integrated with each other, the input terminal being provided on a first end of the branch terminal member and cutting a sheath of the branch cable and penetrating into the sheath to be connected to each of the communication wires, the output terminal being provided on a second end of the branch terminal member and connected to the hoistway cable;

a first support block covering a second surface of the hoistway cable, and compressed against the terminal block to be coupled thereto, thus supporting the hoistway cable on the terminal block with each of the communication wires being connected to the wire terminal member;

a second support block covering a second surface of the branch cable, and compressed against the branch block to be coupled thereto, thus supporting the branch cable on the branch block with each of the communication wires being connected to the branch terminal member; and a cover coupled to cover outer circumferences of the terminal block and the branch block.

2. The branch connecting structure as set forth in claim 1, wherein the wire terminal members, which have been connected to the communication wires arranged in the hoistway cable in parallel, are arranged in a zigzag fashion so as to prevent a short circuit.

3. The branch connecting structure as set forth in claim 1, wherein the output terminal of each of the branch terminal members is bent to be in contact with the output terminal of each of the wire terminal members.

4. The branch connecting structure as set forth in claim 1, wherein the terminal block and the first support block are coupled to each other using a hook, and the branch block and the second support block are coupled to each other using a hook.

5. The branch connecting structure as set forth in claim 1, further comprising:

a seal ring provided between the terminal block and the branch block.

6. The branch connecting structure as set forth in claim 1, further comprising:

a waterproof member provided on each of opposite surfaces of the hoistway cable, thus sealing a gap between the hoistway cable and the terminal block which is in contact with the hoistway cable or a gap between the hoistway cable and the first support block which is in contact with the hoistway cable.

7. The branch connecting structure as set forth in claim 1, further comprising:

a waterproof member provided on each of opposite surfaces of the branch cable, thus sealing a gap between the branch cable and the branch block which is in contact with the branch cable or a gap between the branch cable and the second support block which is in contact with the branch cable.

8. The branch connecting structure as set forth in claim 1, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

9. The branch connecting structure as set forth in claim 2, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

10. The branch connecting structure as set forth in claim 3, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

11. The branch connecting structure as set forth in claim 4, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

12. The branch connecting structure as set forth in claim 5, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

13. The branch connecting structure as set forth in claim 6, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

14. The branch connecting structure as set forth in claim 7, wherein each of the hoistway cable and the branch cable comprises grooves on an outer surface thereof on which the communication wires are placed, and each of the first and second support blocks comprises protrusions which are arranged at predetermined intervals and are inserted into the corresponding grooves.

* * * * *